US010612875B1

(12) United States Patent
Roe

(10) Patent No.: US 10,612,875 B1
(45) Date of Patent: Apr. 7, 2020

(54) REVOLVER RELOADING APPARATUS AND METHOD OF USE

(71) Applicant: Richard Darin Roe, Midland, TX (US)

(72) Inventor: Richard Darin Roe, Midland, TX (US)

( * ) Notice: Subject to any disclaimer, the term of this patent is extended or adjusted under 35 U.S.C. 154(b) by 0 days.

(21) Appl. No.: 16/012,310

(22) Filed: Jun. 19, 2018

Related U.S. Application Data

(63) Continuation of application No. 15/942,719, filed on Apr. 2, 2018, now abandoned.

(60) Provisional application No. 62/479,574, filed on Mar. 31, 2017.

(51) Int. Cl.
*F41A 9/85* (2006.01)

(52) U.S. Cl.
CPC ..... *F41A 9/85* (2013.01)

(58) Field of Classification Search
CPC ..... F41A 9/85
See application file for complete search history.

(56) References Cited

U.S. PATENT DOCUMENTS 223,100 A * 12/1879 Bell ..... F41A 9/85 42/89
394,373 A * 12/1888 Kelton ..... F42B 39/02 42/89
2,637,930 A * 5/1953 Mason ..... F41A 9/85 42/89
2,896,353 A * 7/1959 Hunt ..... F41A 9/85 42/89
3,203,130 A * 8/1965 Diaz ..... F41A 9/85 42/89
3,824,729 A * 7/1974 Kubik ..... F41A 9/85 42/89
4,030,222 A * 6/1977 Sommer ..... F41A 9/85 42/89
4,079,536 A * 3/1978 Hunt ..... F41A 9/85 42/89
4,402,153 A * 9/1983 Peter ..... F41A 9/85 42/89
4,507,889 A * 4/1985 Allen ..... F41A 9/85 42/89
5,842,299 A * 12/1998 Switzer ..... F41A 9/85 42/89
8,136,285 B2 * 3/2012 Abell ..... F41A 9/85 224/198

* cited by examiner

*Primary Examiner* — Joshua T Semick
(74) *Attorney, Agent, or Firm* — Eldredge Law Firm

(57) ABSTRACT

A revolver reloading apparatus includes a holding device, having an elongated body; arms extending radially from the elongated body and to hold cartridges; a cap integrally attached to the elongated body at a position above the plurality of arms; the elongated body connects the cap and the arms; twisting the elongated body while the plurality of cartridges are engaged with barrels of cylinder releases the cartridges from the arms; and the arms are flexible and thereby release the plurality of cartridges.

1 Claim, 6 Drawing Sheets

REVOLVER RELOADING APPARATUS AND METHOD OF USE

BACKGROUND

1. Field of the Invention

The present invention relates generally to revolver style firearms, and more specifically, to a speed loader device for quickly reloading the cylinder of a revolver with new cartridges.

2. Description of Related Art

Revolver style firearms are well known in the art and are effective means to sequentially discharge cartridges in a variety of situations. Revolver style firearms are thus named for having a cylinder that holds multiple cartridges and revolves after one cartridge is discharged in order to discharge the next cartridge. For example, FIG. 1 depicts a conventional speed loader device 101 having a plurality of barrels 103 that hold cartridges 105 and forms a cylinder. A retainer 107 locks the cartridges 105 in the barrels 103. The retainer 107 is released via a spring 109 and a plunger 111. During use, the barrels are aligned with the cylinder of a revolver then plunger 111 is pressed releasing the cartridges 105 in the cylinder.

One of the problems commonly associated with system 101 is its limited efficiency. For example, each revolver has a unique cylinder configuration requiring a separate speed loader 101 for each revolver. Additionally, the cartridges 105 must be packaged and shipped from the manufacturer in boxes or similar materials that are then discarded after the cartridges are placed in the speed loader 101.

Accordingly, although great strides have been made in the area of speed loaders, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
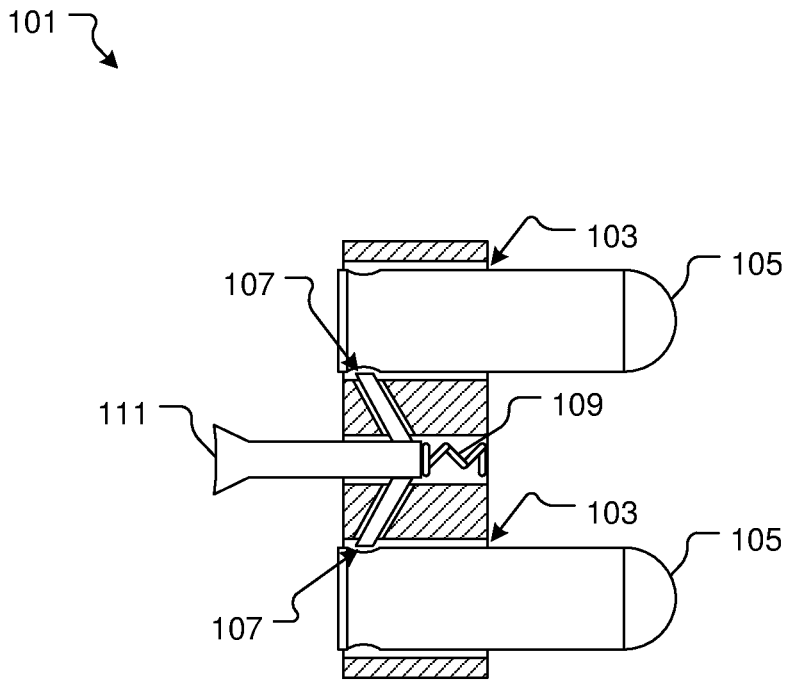
FIG. 1 (Prior Art)
FIG. 1 is a cross-sectional side view of a common speed loader device.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional speed loaders. Specifically, the apparatus of the present application can be used on various revolvers with different cylinders. In addition, the apparatus is used to package and ship the cartridges eliminating the wasted packaging and need to place them in a speed loader. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
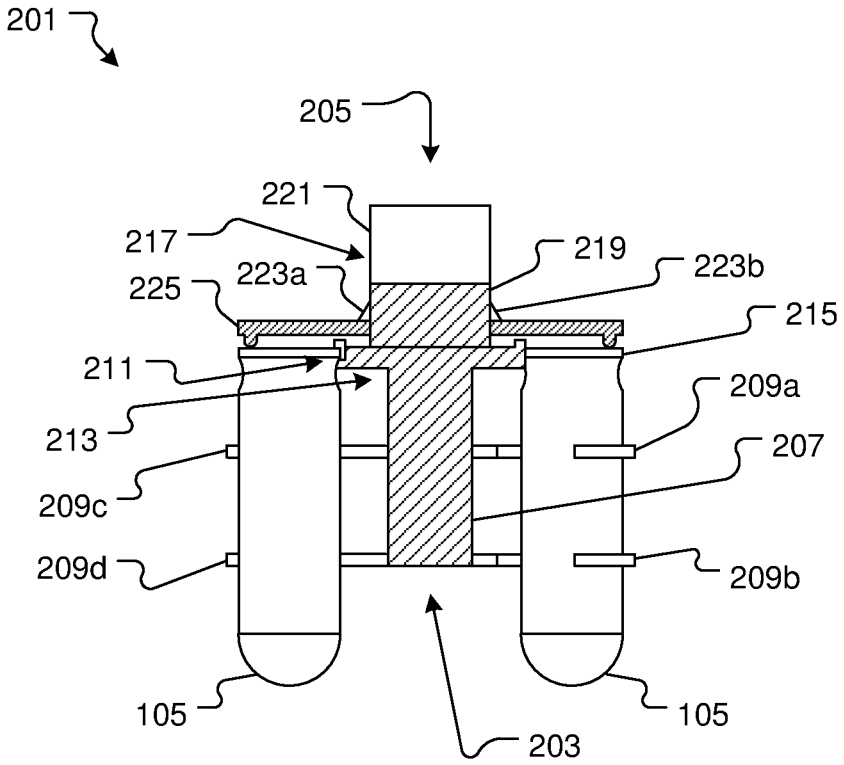
FIG. 2 is a cross-sectional side view of a revolver reloading apparatus in accordance with a preferred embodiment of the present application.

Referring now to the drawings wherein like reference characters identify corresponding or similar elements throughout the several views, FIG. 2 depicts a cross-sectional side view of a revolver reloading apparatus in accordance with a preferred embodiment of the present application. It will be appreciated that system 201 overcomes one or more of the above-listed problems commonly associated with conventional speed loader devices.

In the contemplated embodiment, system 201 includes a cartridge holding device 203 rigidly attached to a handle 205 that is configured to store a plurality of cartridges 105 and transfer them to the cylinder of a revolver.

The holding device 203 having a central body 207 having a plurality of arms 209 attached in pairs or multiples along the length of the body 207. A head 211 extending radially outward from the top end 213 of the body 207 is configured to support the ridges 215 of the cartridges 105.

The handle 205 having body 217 with a base 219 at one end and narrows to form a grip 221 at the opposite end. The base 219 having a plurality of prongs 223 extending outward from the body 219

The apparatus 201 including a cap 225 that has attaches the handle 205 in proximity to the base 219. The cap 225 is forced down against the cartridges 105 an attached via the prongs 223.

Figure 3:
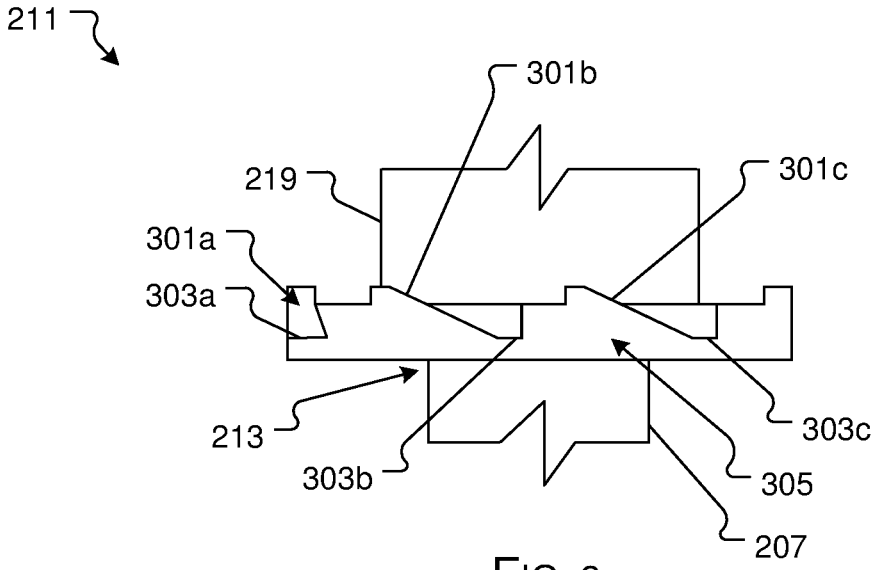
FIG. 3 is a side view of the head of the holding device of FIG. 2.

Referring now to FIG. 3 the head 211 of the holding device 203 is depicted having a plurality of transfer ramps 301. The ramps 301 extend inwards from the outer surface 305 of the head 211. Each ramp 301 terminates in a flat 303 where the ridge 215 of a cartridge 105 rests while being stored. It will be understood that each cartridge 105 will have a corresponding ramp 301 and flat 303. It will be appreciated that the ramps 301 could be of any length to facilitate pushing the cartridges 105 from the arms 209.

Figure 4:
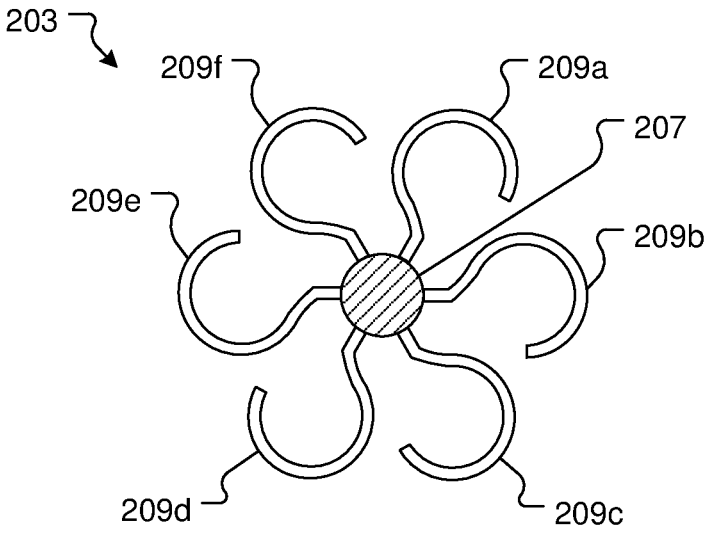
FIG. 4 is a cross-sectional top view of the holding device of FIG. 2.

Referring now to FIG. 4 the arms 209 are depicted rigidly attached and radially arrayed around the central body 207 of the holding device 203. It will be appreciated that the number of arms 209 corresponds to the number of cartridges that a cylinder may hold. While six are depicted here any number is contemplated. It will also be understood that the arm 209 are made of a pliable material so that the stored cartridges 105 can move inward or outward to conform to cylinders of various diameters.

Figure 5:
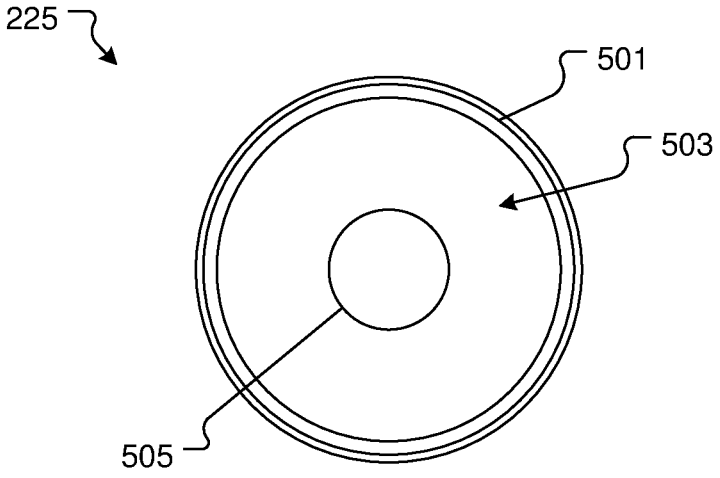
FIG. 5 is a bottom view of the cap of FIG. 2.

Referring now to FIG. 5 the cap 225 is depicted having a retaining ring 501 that extends outward from the bottom surface 503 of the cap 225. The cap 225 having a hole 505 that pass there through and accommodates the base 219 of the handle 205. It will be understood that once cartridges 105 are placed in the arms 209 of the holding device 203 so that the ridges 215 contact the corresponding flat 303, the cap 225 and ring 501 prevent the cartridges 105 from falling out of the device 203. The cap 225 also provides tension to the cartridges 105, assisting them in remaining rigid under normal handling conditions.

In use, cartridges 105 are inserted in the arms 209. A portion of the ridge 215 of each cartridge 105 rests on a flat 303. The cap 225 is pressed over the prongs 223 so that the ring 501 contacts the back of the cartridges 105. The device holder 203 is aligned with the cylinder of a revolver so that the cartridges 105 are position to enter the cylinder. The grip 221 is twisted so that the ridge 215 is forced up the ramp 301. The upward and rotational motion cause the arms 209 to release the cartridges 105 and they fall in the cylinder.

It should be appreciated that one of the unique features believed characteristic of the present application is that arms 209 enable apparatus 201 to insert the cartridges 105 in cylinders of various sizes by flexing as the cartridges 105 enter the cylinder. It will also be appreciated that the cartridges 105 are released from the apparatus 201 via the ramps 301 transferring the rotational force to the ridge 215 of the cartridge 105. It will also be appreciated that the apparatus could be made of recyclable material thus reducing the waste created by packaging materials along with the effort to load the cartridges 105 in a speed loader device 101 or directly to the cylinder.

Figure 6:
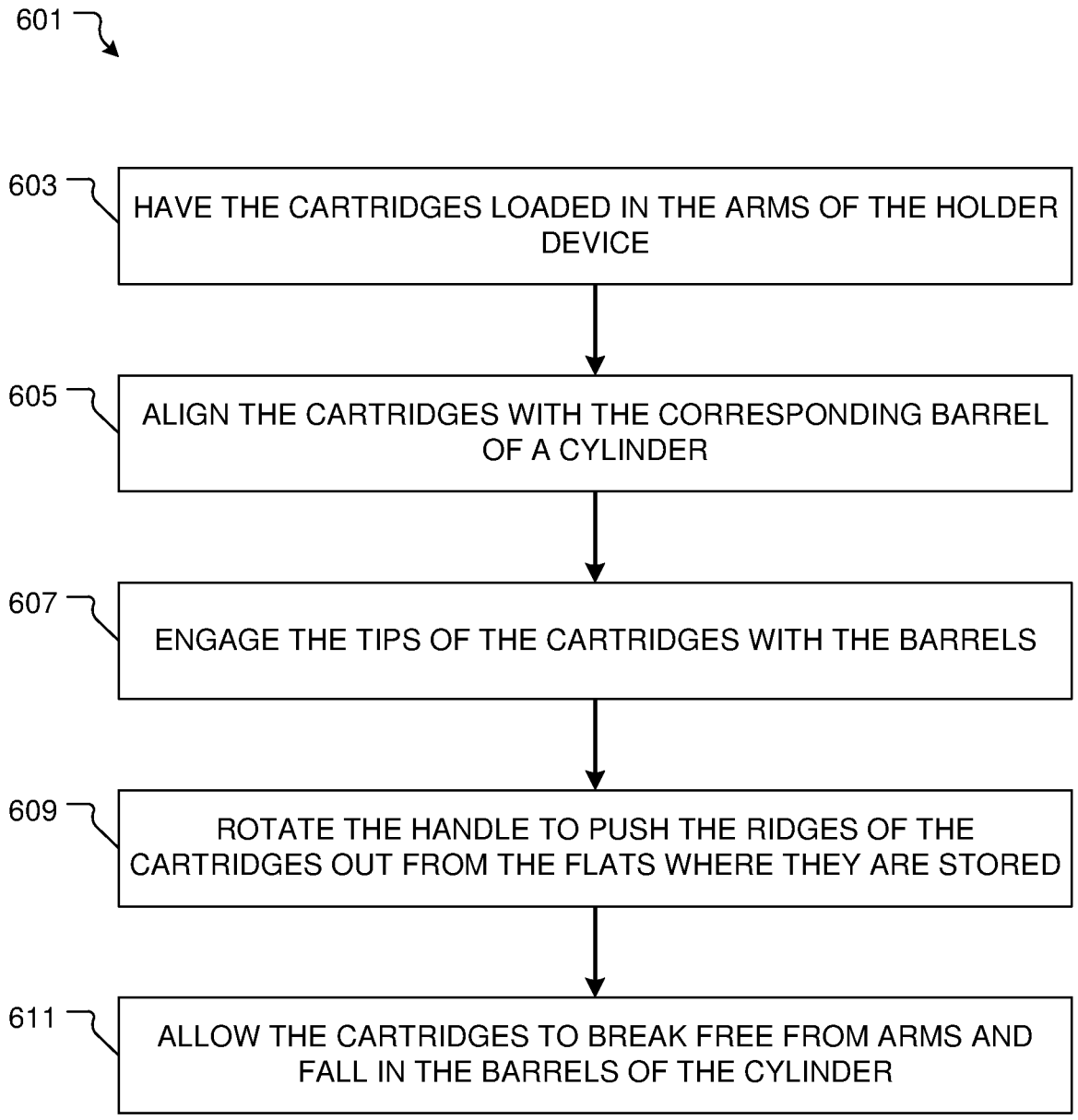
FIG. 6 is a flowchart of the preferred method of use of the apparatus of FIG. 2.

Referring now to FIG. 6 the preferred method of use of the apparatus 201 is depicted. Method 601 including having the cartridges loaded in the arms of the holding device 603, aligning the cartridges with the corresponding barrels of a cylinder 605, engaging the tips of the cartridges with the barrels 607, rotating the handle to push the ridges of the cartridges out from the flats where they are stored 609, allowing the cartridges to break free from the arms and fall in the cylinder 611.

Figure 7:
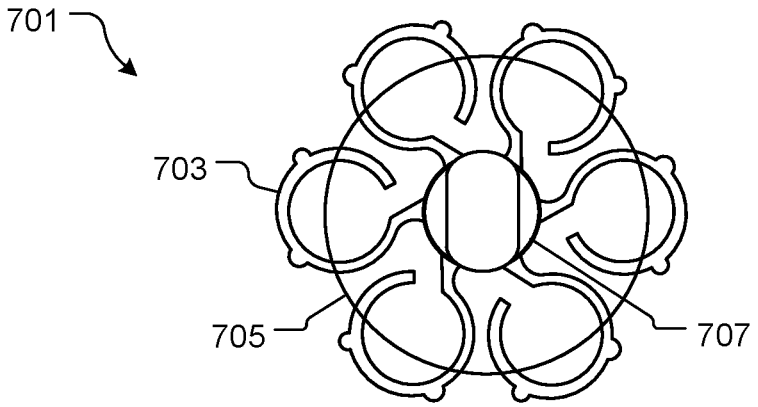
FIG. 7 is a top view of an alternative embodiment of a revolver reloading apparatus in accordance with the present application.
Figure 8:
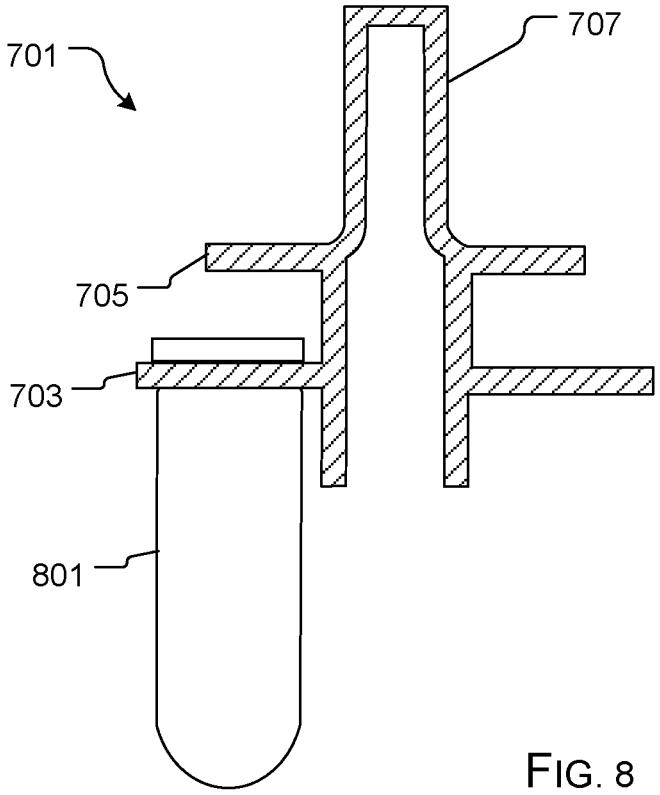
FIG. 8 is a cross sectional side view of the revolver reloading apparatus of FIG. 7.

In FIGS. 7 and 8, an alternative embodiment of a revolver reloading apparatus 701 is shown in accordance with the present application. It should be appreciated that the features discussed herein can be interchanged between the various embodiments. Speed loading apparatus 701 includes a holding device having a plurality of arms 703 extending radially from a body 707 that extends upward (as shown in FIG. 8), to create a handle. The plurality of arms are configured to hold a cartridge 801. This apparatus is similar in form and function to apparatus 201, however, this apparatus provides for a simplified version of a loading apparatus, thereby reducing the cost associated with production.

As shown in FIG. 8, body 707 provides a means to connect a top cap 705 to the plurality of arms 703. It should be appreciated that the plurality of cartridges are aligned with the barrels of cylinder, and as the body 707 is grasped and twisted/lifted, the plurality of arms flex to release the plurality of cartridges.

Figure 9:
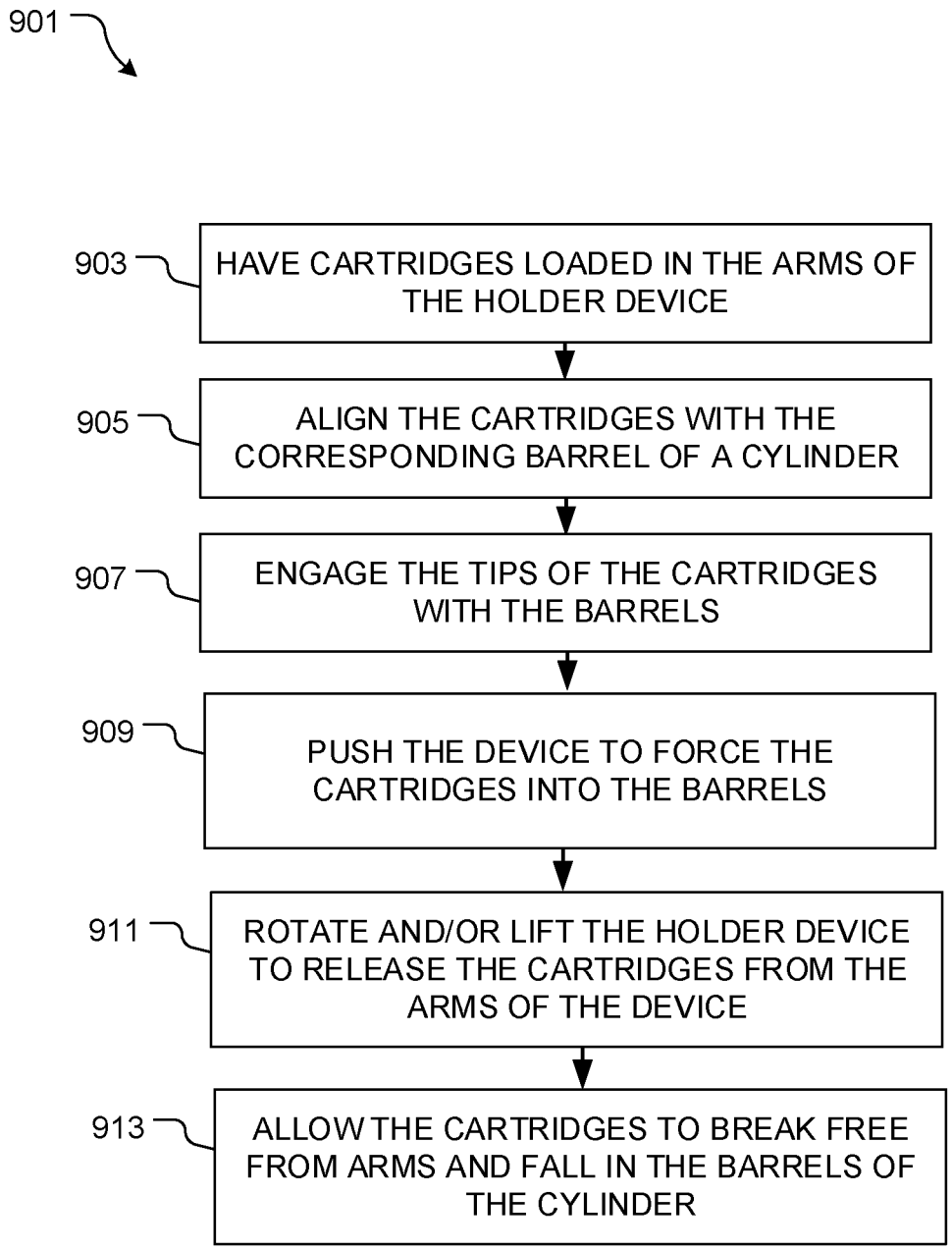
FIG. 9 is a flowchart of the method of use of the revolver reloading apparatus of FIG. 7.

In FIG. 9, a flowchart depicts a method of use of the present invention. During use, the holding device 701 comes with cartridges secured therein, as shown with box 903. When the user desires to load a revolver, the user aligns the cartridges with the corresponding barrels of the cylinder and engages the tips of cartridges therein, as shown with boxes 905, 907. The user pushes the device to force the cartridges into the barrels and rotates and/or lifts the device to release the cartridges from the arms, thereby allowing for the cartridges to fall into the barrels of the cylinder, as shown with boxes 909, 911, 913.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A method of loading cartridges in the cylinder of a revolver comprising:

providing a revolver reloading apparatus comprising:

a holding device, having:

an elongated central body;

a plurality of arms extending radially from the elongated central body and configured to hold a plurality of cartridges, the plurality of arms having a curved body configured to engage with an outer surface of the plurality of cartridges;

a cap integrally attached to the elongated body at a position above the plurality of arms; and a head integral with and extending in a direction perpendicular to an elongated axis of the elongated central body, the head having:

a flat section configured to releasably engage with a ridge of a cartridge of the plurality of cartridges; and a ramp adjacent to the flat section;

wherein the head is configured such that the ridge of the cartridge rests on the flat section; and wherein the ridge slides on the ramp and moves relative to the elongated central body upon rotational movement of the central body;

wherein the elongated central body connects the cap and the plurality of arms;

wherein the plurality of cartridges are secured in position via the cap, the plurality of arms, and the head of the elongated central body;

wherein rotational movement of the elongated body causes the plurality of cartridges to disengage with the head and the plurality of arms;

loading the plurality of cartridges in the plurality of arms and the flat section of the head;

aligning the cartridges with corresponding barrels of a cylinder;

engaging tips of the plurality of cartridges with the barrels;

twisting the elongated central body to release the plurality of cartridges from the plurality of arms and from the flat section via the ramp; and disengaging the plurality of cartridges from the plurality of arms and the flat section of the head.

* * * * *